US008246813B2

(12) United States Patent
Compton et al.

(10) Patent No.: US 8,246,813 B2
(45) Date of Patent: Aug. 21, 2012

(54) METHOD OF REMOVING HYDROGEN SULFIDE

(75) Inventors: Dennis R. Compton, Sugar Land, TX (US); Samuel Jefferies, Cubert (GB); Ron Sharpe, Lymington (GB)

(73) Assignee: Nalco Company, Naperville, IL (US)

( * ) Notice: Subject to any disclaimer, the term of this patent is extended or adjusted under 35 U.S.C. 154(b) by 430 days.

(21) Appl. No.: 12/638,365

(22) Filed: Dec. 15, 2009

(65) Prior Publication Data

US 2011/0139686 A1 Jun. 16, 2011

(51) Int. Cl.

| | |
|---|---|
| ***C10G 29/16*** | (2006.01) |
| ***C10G 29/06*** | (2006.01) |
| ***C10G 17/09*** | (2006.01) |
| ***C10G 17/02*** | (2006.01) |

(52) U.S. Cl. ..... 208/239; 208/208 R; 208/219

(58) Field of Classification Search ..... None
See application file for complete search history.

(56) References Cited

U.S. PATENT DOCUMENTS 5,000,835 A 3/1991 Taylor et al.

FOREIGN PATENT DOCUMENTS

EP 0121377 B1 4/1987
EP 0421683 A1 5/1997

OTHER PUBLICATIONS

J.A. Andor, et al., Physical and Chemical Modification of Zinc Carboxylate-containing Lubricants by Molecular Structure Changes, Feb. 1999 Lubrication Science, vol. 11, No. 2, pp. 115-134.*

* cited by examiner

*Primary Examiner* — Walter D Griffin
*Assistant Examiner* — Derek Mueller
(74) *Attorney, Agent, or Firm* — Benjamin E. Carlsen; Andrew D. Sorenson

(57) ABSTRACT

The invention provides a method of removing sulfides from viscous petroleum streams such as asphalt, crude oil, and oil slurry using zinc octoate in which the molar ratio of zinc complexed with octanoic acid is not 1:2. Because zinc has a +2 charge and carboxylic acid has a −1 charge, it was previously assumed that all zinc octoates must have a 1:2 ratio of zinc moieties to carboxylic acid. Zinc octoate formulations however, that contain a non 1:2 ratio, and those with 2.1:3 to 1.97:3 in particular, have in fact been shown to work better. In addition, these non 1:2 formulations have lower viscosity and therefore are easier to use than the previous formulations including a 1:2 ratio.

12 Claims, 1 Drawing Sheet

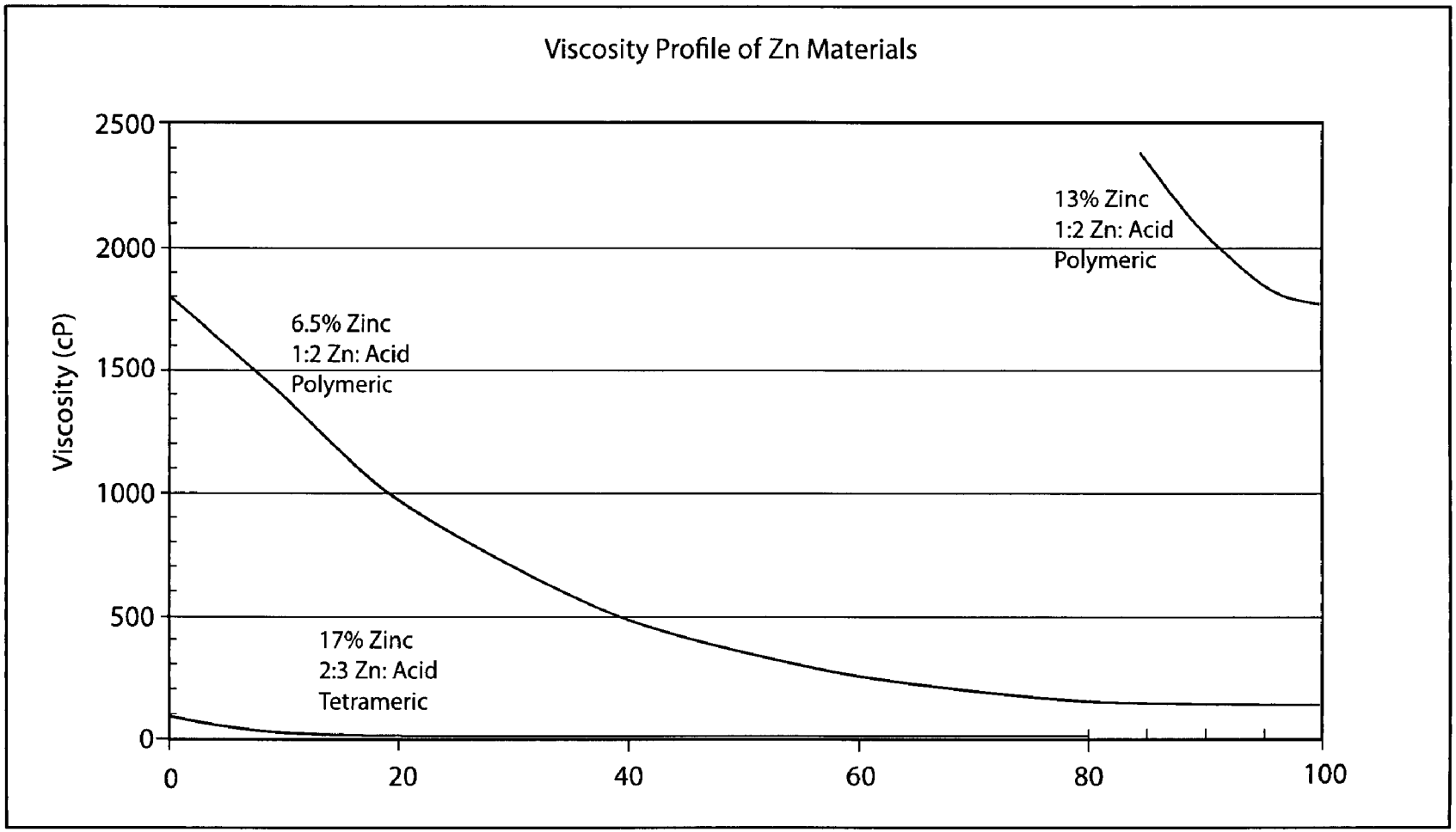
Viscosity Profile of Zn Materials
Viscosity (cP)
2500
2000
1500
1000
500
0
0
20
40
60
80
100
13% Zinc
1:2 Zn: Acid
Polymeric
6.5% Zinc
1:2 Zn: Acid
Polymeric
17% Zinc
2:3 Zn: Acid
Tetrameric

METHOD OF REMOVING HYDROGEN SULFIDE

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to the use of zinc octoates as hydrogen sulfide scavengers. Petroleum asphalt is produced as a residue of a thermal separation refinery process. The thermal separation process causes thermal cracking to occur which frequently causes hydrogen sulfide to be present in the asphalt stream. In fact, thermal cracking continues in the asphalt even after the asphalt has left the vacuum distillation section of the operation, particularly at high temperature. In order to permit the safe loading, handling, and storage of the asphalt, it is necessary to reduce the hydrogen sulfide to safe levels in the asphalt. This has been done in the past by weathering of the hot asphalt for sufficient time for the hydrogen sulfide to be reduced to safe levels. This not only takes a considerable amount of time (several days), but it releases hydrogen sulfide to the vapor space in the storage, which could create hazardous conditions. Moreover, recent emphasis on environmental regulations in Europe stresses the limits on the hydrogen sulfide content of vent gas.

Other efforts to avoid these problems involve operating the vacuum distillation tower at a lower temperature to reduce thermal cracking in the residue. Lower temperature operation is achieved by increasing the flow of asphalt in a quench loop. This, however, is less efficient than operating at higher temperatures and decreases throughput and thermal recovery. Other related methods of addressing this situation are described in European Patent Specification, Publication No. 0121377 and European Patent 000 421 683 A1.

U.S. Pat. No. 5,000,835 describes using metal carboxylates as hydrogen scavengers. This patent describes the reaction between metal carboxylates with 6 to 24 carbon atoms. In these metal carboxylates, the carbonyl group functions as a carrier for the oppositely charged metal and places the metal into a form which is soluble in an organic environment and able to make contact with dissolved hydrogen sulfide. When the metal in the metal carboxylates reacts with dissolved hydrogen sulfide, the two form insoluble metal sulfides, which eliminate the toxic and corrosive properties of the hydrogen sulfide. While this patent does mention the use of zinc octoate, which is oil soluble and readily available it also notes that zinc octoate is less effective than other metal carboxylates.

Thus there is clear need and utility for an improved method of using zinc octoate as a hydrogen sulfide scavenger. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment of the invention is directed towards a method for removing sulfides from viscous petroleum streams such as asphalt, crude oil, and oil slurry. The method comprises the step of adding to the stream an effective amount of a zinc octoate, wherein the molar ratio of zinc complexed with octanoic acid is not 1:2. The zinc octoate may be an oxo zinc octoate and it may be a tetranuclear oxo zinc octoate. The molar ratio of zinc to octanoic acid may be greater than 1:2. The zinc octoate may be added in a fluid with a viscosity less than that of a similar fluid with a 1:2 molar ratio of zinc to octanoic acid.

At least one embodiment of the invention is directed towards a method for removing sulfides from a petroleum stream with a fluid containing a molar ratio of zinc to octanoic acid of 2.1:3, 1.97:3, or a range of between 2.1:3 to 1.97:3. The dosage of zinc octoate added to the organic liquid may be from 1 to 2000 ppm. The addition may reduce at least 50% of the sulfides. The zinc octoate may be added in a low viscosity fluid in which zinc metal content comprises between 5% and 20% by weight of the fluid.

BRIEF DESCRIPTION OF THE DRAWINGS

A detailed description of the invention is hereafter described with specific reference being made to the drawings in which:

FIG. 1 is a graph showing the viscosity of various zinc octoates as hydrogen sulfide scavengers. The lower the viscosity of the material the easier it is to add and disperse into the asphalt

DETAILED DESCRIPTION OF THE INVENTION

Zinc octoate is an 8-carbon carboxylic acid (specifically 2 ethyl hexanoic acid) in which a zinc ion coordinates with the oxygen atoms of the acid. Because zinc has a +2 charge and carboxylic acid has a −1 charge, it was previously assumed that all zinc octoates must have a 1:2 ratio of zinc moieties to carboxylic acid. As represented in FIG. 1, these 1:2 zinc octoates, tend to polymerize and form highly viscous materials, which makes their practical usefulness as a hydrogen sulfide scavenger very limited.

In at least one embodiment a zinc octoate is used which has a non 1:2 acid to zinc ratio. In an oxo zinc carboxylate, one or more oxygen atoms are bonded with two or more zinc atoms and the formed oxo-zinc group is the zinc species that becomes complexed with the carbonyl group of the carboxylic acid. In at least one embodiment the oxo-zinc group is a tetranulcear oxo-zinc in which four zinc atoms are bonded with one oxygen group and forms a 2:3 ratio of zinc to carboxylic acid.

In one embodiment, the ratio of zinc to carboxylic acid ratio ranges from 1.97:3 to 2.1:3.

This ratio facilitates the reaction of all of the zinc and prevents the appearance of haze, which is indicative of residual unreacted zinc oxide.

The use of these non 1:2 ratio zinc octoates imparts a number of advantages. Firstly the resulting octoate has more zinc atoms to be present per mol of octoate. Because the zinc atoms are the primary impetus of removing the sulfides, concentrating more zinc per mol increases the effectiveness of the octoate. Secondly as shown in FIG. 1, non 1:2 ratio zinc octoates have lower viscosities than 1:2 octoates resulting in an octoate which is more applicable and which can have a concentration that is more effective than more viscous zinc octoates. The lower viscosity is quite an unexpected result as one would think that a complex that binds more molecules together would have a higher viscosity, yet the test results demonstrate that when in this 2:3 ratio a lower viscosity results. FIG. 1 illustrates this reduced viscosity relative to temperature for the tetra oxo and polymer forms of zinc octoate prepared in an aromatic solvent.

The chemical structure of tetranuclear oxo zinc octoate is:

$$\mu\text{-}Zn_4O\text{-}\mu\text{-}(O_2C_8H_{15})_6$$

EXAMPLES

The foregoing may be better understood by reference to the following example, which is presented for purposes of illustration and is not intended to limit the scope of the invention.

A number of samples were prepared in the same aromatic solvent. The various samples were tested for vapor space $H_2S$ levels using Draeger Tubes. Table I illustrates the sample's effectiveness after heating for 2 hours at temperatures of 315-325° F. Table II illustrates that the inventive composition is highly effective even after shorter time periods.

TABLE I

| Test No. | Additive Description | Additive Treat in Asphalt (ppm) | H2S Level (ppm) No Treatment | H2S Level (ppm) With Treatment |
|---|---|---|---|---|
| 1 | 5.5% Iron Octoate | 99 | 4500 | 3250 |
| 2 | 5.5% Iron Octoate | 301 | 4500 | 2700 |
| 3 | 5.5% Iron Octoate | 702 | 3500 | 425 |
| 4 | 5.5% Iron Octoate | 1769 | 3500 | 40 |
| 5 | 17% Zinc Octoate tetrameric complex | 100 | 4500 | 2250 |
| 6 | 17% Zinc Octoate tetrameric complex | 291 | 4500 | 1100 |
| 7 | 17% Zinc Octoate tetrameric complex | 541 | 3500 | 75 |
| 8 | 17% Zinc Octoate tetrameric complex | 695 | 3500 | 30 |
| 9 | 17% Zinc Octoate tetrameric complex | 1744 | 3500 | 0 |
| 10 | 17% Zinc Octoate tetrameric complex | 988 | 5000 | 10 |
| 11 | 13% Zinc Octoate polymeric complex | 996 | 5000 | 30 |
| 12 | 6.5% Zinc Octoate polymeric complex | 979 | 5000 | 775 |

TABLE II

| Test No. | Additive Description | Additive Treat in Asphalt (ppm) | Time | H2S Level (ppm) No Treatment | H2S Level (ppm) With Treatment |
|---|---|---|---|---|---|
| 1 | 17% Zinc Octoate tetrameric complex | 1013 | 1 min | 5000 | 100 |
| 2 | 17% Zinc Octoate tetrameric complex | 998 | 30 min | 5000 | 35 |
| 3 | 17% Zinc Octoate tetrameric complex | 991 | 2 hours | 5000 | 20 |
| 4 | 17% Zinc Octoate tetrameric complex | 994 | 4 hours | 5000 | 5 |

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other is equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method removing sulfides from petroleum streams, the method comprising the step of adding to the organic liquid an effective amount of a zinc octoate, wherein the molar ratio of zinc complexed with octanoic acid is not 1:2.

2. The method of claim 1 wherein the zinc octoate is an oxo zinc octoate.

3. The method of claim 1 wherein the zinc octoate is tetranuclear oxo zinc octoate.

4. The method of claim 1 in which the molar ratio of zinc to octanoic acid is greater than 1:2.

5. The method of claim 1 in which the zinc octoate is added in a fluid and the viscosity of the fluid is less than the viscosity of a similar fluid with a 1:2 molar ratio of zinc to octanoic acid.

6. The method of claim 1 wherein the petroleum stream is one selected from the list consisting of: asphalt, crude oil, oil slurry, and any combination thereof.

7. The method of claim 1 in which the molar ratio of zinc to octanoic acid is 2.1:3.

8. The method of claim 1 in which the molar ratio of zinc to octanoic acid is 1.97:3.

9. The method of claim 1 in which the molar ratio of zinc to octanoic acid is from 2.1:3 to 1.97:3.

10. The method of claim 1 in which the dosage of zinc octoate added to the organic liquid is from 1 to 2000 ppm.

11. The method of claim 1 in which the added zinc octoate reduces at least 50% of the sulfides.

12. The method of claim 1 in which the zinc octoate is added in a low viscosity fluid and zinc metal content comprises between 5% and 20% by weight of the fluid.

* * * * *